United States Patent [19]

Hunter

[11] 4,398,640

[45] Aug. 16, 1983

[54] MULTI-SPAN SKYLINE LOGGING SYSTEM

[76] Inventor: Shubert J. Hunter, P.O. Box 273, Estacada, Oreg. 97023

[21] Appl. No.: 238,690

[22] Filed: Feb. 27, 1981

[51] Int. Cl.[3] ..... B63C 19/00

[52] U.S. Cl. ..... 212/76; 104/115; 212/71; 212/94

[58] Field of Search ..... 212/209, 210, 71, 73, 212/74, 76, 77, 83, 86, 87, 94–103, 106, 110, 117, 124, 133, 134, 140, 142.1; 104/115–117, 165, 174, 175, 178, 179, 182, 197

[56] References Cited

U.S. PATENT DOCUMENTS

| | | | |
|---|---|---|---|
| 844,125 | 2/1907 | Harris | 104/197 |
| 1,481,746 | 1/1924 | Sackett | 104/115 |
| 1,484,387 | 2/1924 | Dickinson | 104/115 |
| 1,501,748 | 7/1924 | Chapman et al. | 104/182 |
| 3,330,223 | 7/1967 | Gaynor | 104/178 |
| 3,476,385 | 11/1969 | Foy | 212/74 |

*Primary Examiner*—Trygve M. Blix
*Assistant Examiner*—Stephen P. Avila
*Attorney, Agent, or Firm*—Eugene M. Eckelman

[57] ABSTRACT

An arcuate jack is arranged to be secured to a spar for supporting a skyline over it. A carriage assembly comprises a main carriage arranged to travel on the skyline and a secondary carriage supported on the main carriage for movement between leading and trailing ends of such main carriage. A brake is operative between the main and secondary carriages to control movement of the secondary carriage on the main carriage. The secondary carriage supports a drop line for connection to a load, and a mainline is connected to the secondary carriage for pulling the carrige assembly along the skyling. A guide for the mainline is provided on the spar and is disposed below the jack in an arrangement whereby the pull on the carriage assembly from the mainline is substantially tangent to the arcuate contour of the jack at its entrance end. The brake is arranged to hold the secondary carriage at the trailing end of the main carriage during initial movement of the latter onto the jack and in subsequent movements thereof along the jack to release it for movement toward the leading end of the main carriage, thus providing a weight shift that assists movement of the carriage over the jack. A clearance cam is provided which is arranged to be engaged by the carriage assembly and which is arranged to swing the carriage assembly out at the bottom so that the drop line will bypass the guide.

6 Claims, 6 Drawing Figures

MULTI-SPAN SKYLINE LOGGING SYSTEM

BACKGROUND OF THE INVENTION

This invention relates to new and useful improvements in multi-span skyline logging systems. Multi-span skyline logging systems have heretofore been used for the purpose of moving logs in elevated position over the ground surface, thus preserving ground cover or other growth. A limitation of multi-span systems is that it is difficult to move loaded carriages over the jacks of spar poles. Such difficulty is more prevalent in modern day logging since certain factors require logging in extremely uneven terrain whereby much of the existing skyline logging systems cannot cope with the angles necessary to move the carriages over the jacks at the spars.

SUMMARY OF THE INVENTION

According to the present invention and forming primary objectives thereof, a multi-span skyline logging system is provided that is designed for improved operation and one that will operate efficiently over greater angular dispositions of the main line at the spar jacks. A further objective of the invention is to provide a carriage assembly supported on the skyline having a structure which allows for a shift in weight of the load to assist movement of the carriage over the jack.

In carrying out the above objectives, an arcuate jack having means for support on a spar is associated with a skyline which supports carriage means having a drop line for a load. A mainline is connected to the carriage means for pulling it along the skyline. Guide means are supported on the spar member for the mainline and such guide means are disposed adjacent to the jack whereby the pull on said carriage means from said mainline is substantially tangent to the arcuate contour of said jack at its entrance end. Clearance means between the carriage and the spar are provided to swing the carriage outwardly at the bottom to allow by-pass of the drop line past the guide means. The carriage means comprises a main carriage which is supported on the skyline and a secondary carriage movably supported on the main carriage. Brake means are provided between the two carriages and arranged to hold the secondary carriage at the trailing end of the main carriage during initial movement of the latter onto the jack and in subsequent movements thereof along the jack to release it for movement toward the leading end of the main carriage to provide a weight shift that assists movement of the carriage over the jack.

The invention will be better understood and additional objects and advantages will become apparent from the following description taken in connection with the accompanying drawings.

DETAILED DESCRIPTION OF A PREFERRED EMBODIMENT

With particular reference to the drawings, the numeral 10 designates an intermediate spar, such as a spar pole or member, in a multi-span logging system. Such a spar is associated with a skyline 12 which as is well known is anchored at opposite ends to suitable means not shown. Also provided in this type of logging system is a mainline 14 connected to powered winch means, also not shown, and arranged in a conventional manner to move a carriage along the skyline. Spar 10 supports a jack 16 which in turn supports the skyline 12 at the spar, such jack and other elements of the assembly having novel features as will now be described.

Figure 2:
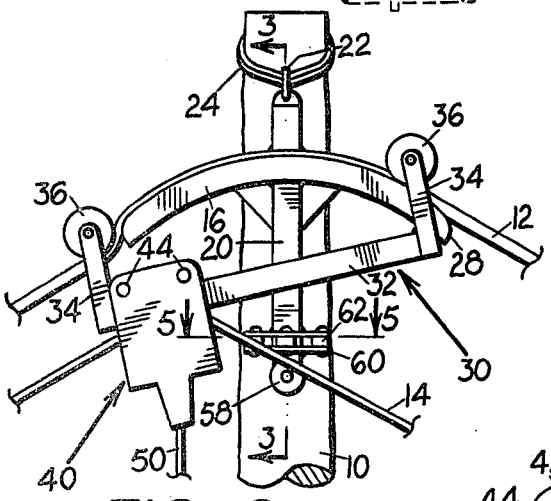
FIG. 2 is a view similar to FIG. 1 but showing a different travelling position of the carriage on the jack.
Figure 5:
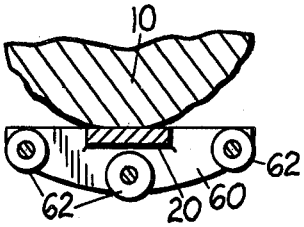
FIG. 5 is a fragmentary sectional view taken on the line 5—5 of FIG. 2.
Figure 3:
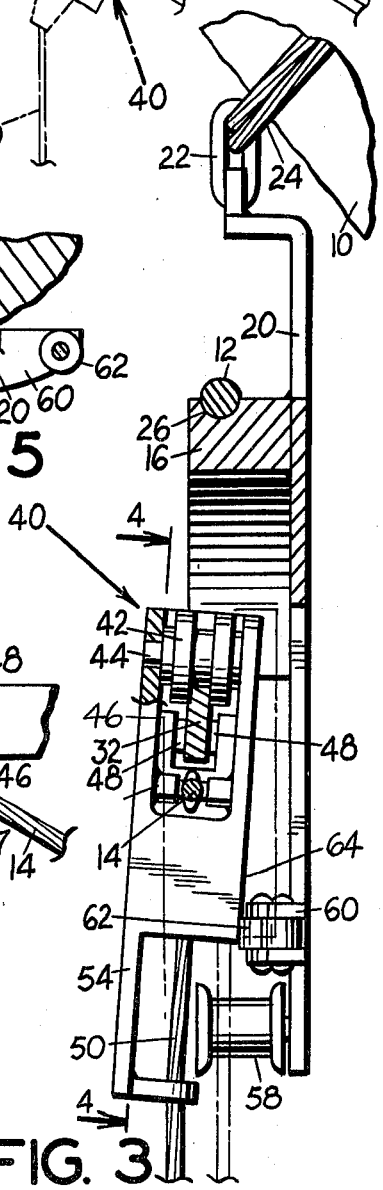
FIG. 3 is an enlarged vertical sectional view taken on the line 3—3 of FIG. 2.

Jack 16 is integrated with a support bar 20 arranged to be connected to an upper portion of the spar 10. In a preferred arrangement, the support bar 20 hangs freely from its support on the spar and for this purpose it may have a top ring 22 secured to a cable 24 wrapped around the spar. As best seen in FIG. 3, the skyline 12 lays in a groove 26 in the jack 16, the terminal ends of the jack, FIGS. 1 and 2, being rounded at 28 on the upper portion thereof.

Figure 6:
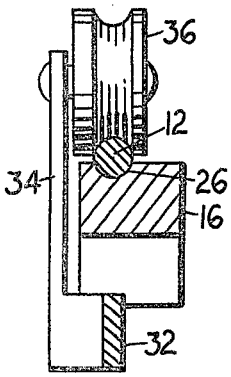
FIG. 6 is a sectional view taken on the line 6—6 of FIG. 1.

The carriage assembly of the instant invention comprises a main carriage 30 consisting of an elongated body portion 32 having an integral upstanding arm 34 at each end. These arms have an off-set end facing the spar as best shown in FIG. 6 which supports sheaves 36 arranged for moving support on the skyline 12 as well as over the jack, FIGS. 1 and 2.

Figure 4:
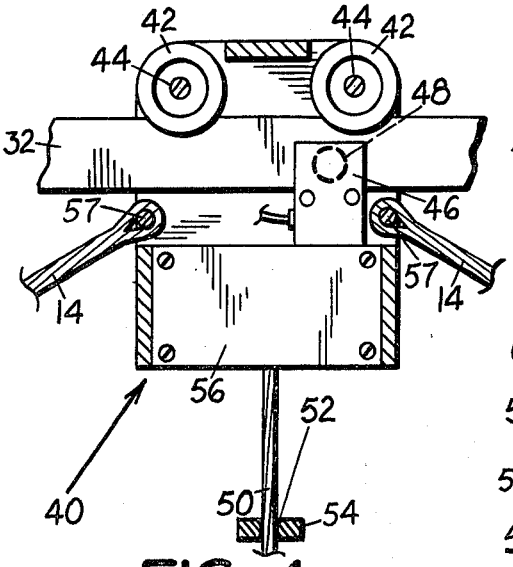
FIG. 4 is a fragmentary sectional view taken on the line 4—4 of FIG. 3.

A secondary carriage 40 is supported on the main carriage 30 and for this purpose such secondary carriage has two or more top sheave assemblies 42, best seen in FIGS. 3 and 4, supported on shafts 44 journaled in the secondary carriage. Sheave assemblies 42 have rolling engagement on the top edge of the main carriage body portion 32. Movement of the secondary carriage on the main carriage is controlled by a brake mechanism 46 secured on the secondary carriage and arranged for braking engagement such as by solenoid operated brake shoes 48 with the sides of the body portion 32. Suitable and conventional operating means, not shown, are employed with the brake mechanism 46 to engage and release it. Such operating mechanism may be actuated by suitable control lines or by remote control in a conventional manner.

Secondary carriage 40 supports a drop line 50 extending through a confining guide aperture 52 in a depending angular arm 54 on the secondary carriage and having suitable conventional means, such as choker means, at its lower end for releasable connection to logs L. The secondary carriage has suitable and conventional winch mechanism, not shown, to which the drop line 50 is connected for the purpose of raising and lowering this line.

The mainline 14 has its opposite ends connected to anchor points 57 on the secondary carriage. FIG. 4, and such mainline is operative by suitable mechanism and guide means in a conventional manner to move the carriage assembly back and forth on the skyline.

The bottom end of bar 20 supports a spool 58 providing guided support for the mainline 14 on the spar in operations to be described. Bar 20 also has clearance means 60 secured thereto below the jack 16. The clearance means 60 includes a plurality of vertical axis rollers 62 arranged to provide a camming action against an inner cam follower wall surface 64 of the secondary carriage 40. As best apparent in FIG. 3, the bottom of secondary carriage 40 will be swung out as the said second carriage moves over the jack, and the arrangement is such that camming action produced by the clearance means 60 allows the drop line 50 to clear the spool 58 as the carriage assembly moves past the spar.

An important feature of the present logging system is that the arrangement allows the mainline 14 to pull the main carriage 30 onto the entrance end of the jack 16 so that the pull on such carriage is substantially tangent to the arcuate contour of the jack. That is, since the mainline 14 is supported up close to the jack 16 by means of the guide spool 58, it will provide a pull in such tangent direction. This mainline support and consequent improved pulling function on the carriage is capable of achievement as a result of the clearing function of the secondary carriage past the spool 58. Such pulling function of the mainline on the carriage means allows the sheaves 36 to roll freely onto the jack 16 without any appreciable countering forces produced by a mainline.

Figure 1:
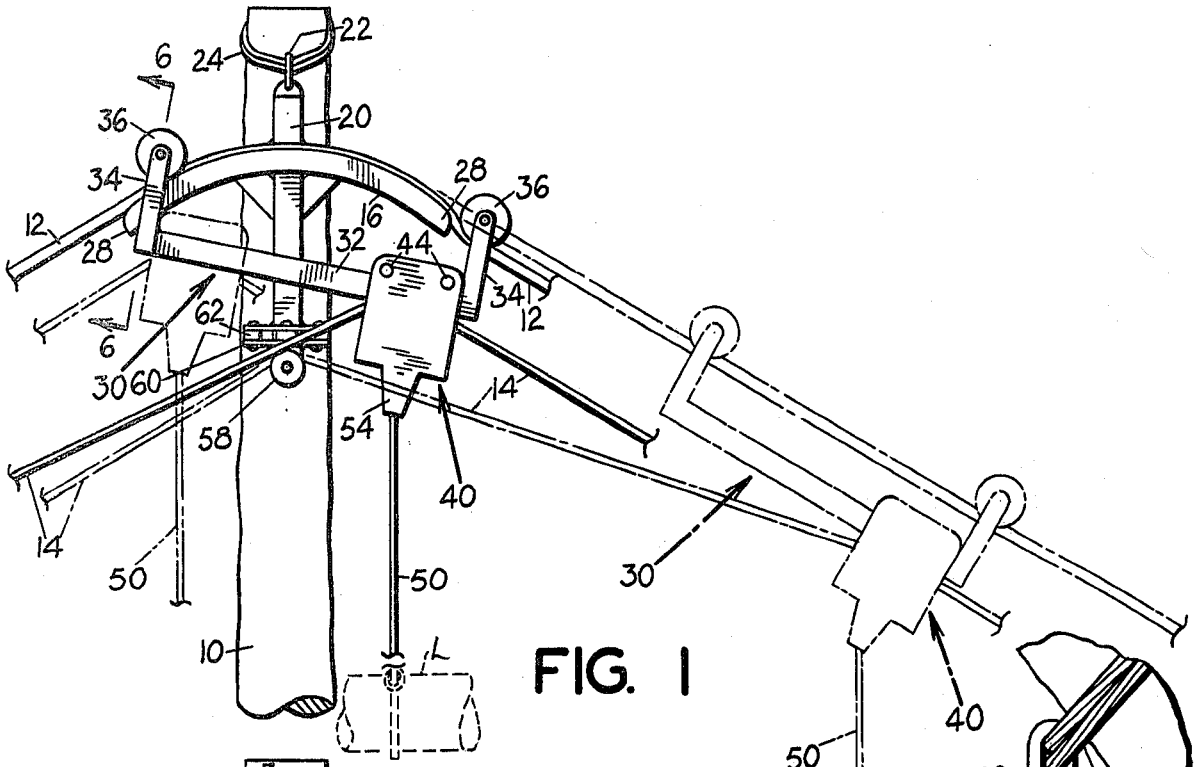
FIG. 1 is an elevational view of a multi-span skyline logging system employing the present invention.

Another important feature of the invention comprises the shifting capability of the secondary carriage 40 on the main carriage 30. Such feature will become more apparent from a description of the operation of the carriage assembly over the jack, as follows:

With reference to the right side of FIG. 1, the carriage assembly is shown in broken lines in a position approaching the jack 16. In such position, the secondary carriage 40 is locked in place at the trailing end of the main carriage 30 by the brake mechanism 46. As the carriage assembly approaches the jack, the pull from the mainline 14 moves the leading sheave 36 onto the jack, it being apparent that since the secondary carriage is located at the trailing end of the main carriage, the lightweight leading end of the carriage means will move readily onto the jack. The secondary carriage 40 is kept in locked position on the main carriage until the trailing sheave 36 is about to engage the entrance end of the jack 16, namely until the carriage assembly reaches the position shown in full lines. The brake 46 is then released whereby the carriage 40 will be pulled by the mainline to the leading end of the main carriage 30. This shifts the weight to the leading end of the carriage assembly, namely, to the broken line position shown at the left in FIG. 1, and the trailing sheave 36 will lift easily onto the entrance end of the jack 16 and the carriage assembly is then movable, as shown in FIG. 2, over the jack and down the skyline. As the carriage assembly approaches another intermediate spar, the secondary carriage is allowed to roll back to the trailing end of the main carriage and it is again locked in place by the brake 46. It is preferred that the jack 16 be slightly longer than the span between the two sheaves 36 for smooth operation of the carriage assembly over the jack. Support bar 20 is free to pivot on its top support to relieve stresses in the assembly.

The carriage assembly can of course operate in a similar manner in the other direction if desired.

According to the present invention, a logging system is provided that allows for efficient movement of a carriage assembly over a jack and in addition the specific arrangement of guide means 58 and the camming effect provided by the clearance means 60 increases the angle of support of skylines at intermediate spars on which skyline carriages can operate.

The spar 10 preferably is tilted rearwardly away from the jack from top to bottom as seen in FIG. 3 or else the support bar 20 is suspended on a cable attached between two closely spaced spar poles, these supporting methods allowing the bar 20 to swing somewhat in operations of the logging system so as to be free from lateral stresses. Also, the guide aperture 52 for the drop line 50 is disposed below the plane of the guide spool 58 to maintain the drop line free of such spool at all times that the carriage 40 is swung out by the cam assembly 60. The assembly of the jack and the carriages is well balanced in that the point of support of the bar 20 at the top, the cable support point 26, and the supporting point 32 for the secondary carriage are in substantially a straight line.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A multi-span skyline logging system of a type using a spar member, said system comprising (a) an arcuate jack having entrance and exit ends, (b) support means on said jack arranged to secure it to a spar member, (c) a skyline extending over said jack in supported relation, (d) carriage means arranged for movable support along said skyline and over said jack, (e) drop line means on said carriage for connection to a load of logs, (f) mainline means connected to said carriage means arranged to pull the latter along the skyline, (g) guide means arranged to be supported on the spar member over which said mainline is trained for guided movement, (h) said guide means being disposed adjacent to said jack in an arrangement whereby the pull on said carriage means from said mainline is substantially tangent to the arcuate contour of said jack at its entrance end, (i) and interengaging clearance means on said spar member and said carriage, (j) said clearance means including a cam and cam follower, (k) one of said cam and cam follower being disposed on said spar member below said jack and the other of said cam and cam follower being disposed on said carriage means, (l) said cam projecting horizontally outwardly and being arranged when engaged by said cam follower as said carriage means moves over said jack to swing said carriage means outwardly at the bottom to allow bypass of said drop line past said guide means.

2. The multi-span logging system of claim 1 wherein said support means also supports said guide means, and means on said support means arranged to hang it for swinging movement on the spar.

3. The multi-span logging system of claim 1 wherein said carriage means includes a main carriage having leading and trailing ends, means supporting said main carriage on said skyline, a secondary carriage supported movably on said main carriage for movement between the leading and trailing ends of the latter, said mainline being connected to said secondary carriage for exerting the pulling force, and brake means between said secondary carriage and said main carriage, said brake means being arranged to hold said secondary carriage at the trailing end of said main carriage during initial movement of the latter onto said jack and in subsequent movements thereof along said jack to release it for movement toward said leading end of said main carriage to provide a weight shift that assists movement of said carriage means over said jack.

4. The multi-span logging system of claim 3 wherein said main carriage comprises an elongated body member on which said secondary carriage is movably supported, upwardly projecting arms on said body member, and sheave means on said arm arranged for movement on said skyline and over said jack.

5. A multi-span logging system comprising (a) an arcuate jack having entrance and exit ends, (b) means on said jack arranged to secure it to a spar member, (c) a skyline extending over said jack in supported relation, (d) a main carriage having leading and trailing ends and arranged for movable support along said skyline and over said jack, (e) a secondary carriage supported movably on said main carriage for movement between the leading and trailing ends of the latter, (f) drop line means on said second carriage for connection to a load of logs, (g) mainline means connected to said secondary carriage arranged to pull the latter along the skyline;

(h) and brake means between said secondary carriage and said main carriage;

(i) said brake means being arranged to hold said secondary carriage at the trailing end of said main carriage during initial movement of the latter onto said jack and in subsequent movements thereof along said jack to release it for movement toward said leading end of said main carriage to provide a weight shift that assists movement of said carriages over said jack.

6. The multi-span logging system of claim 5 wherein said main carriage comprises an elongated body member on which said secondary carriage is movably supported, upwardly projecting arms on said body member, and sheave means on said arm arranged for movement on said skyline and over said jack.

* * * * *